US007435518B2

(12) United States Patent
Graham et al.

(10) Patent No.: US 7,435,518 B2
(45) **Date of Patent: *Oct. 14, 2008**

(54) METHOD OF TREATING AN ELECTROPHOTOGRAPHIC-IMAGING MEMBER WITH A RARE EARTH MATERIAL

(75) Inventors: John Graham, Oakville (CA); Nancy Belknap, Rochester, NY (US); Kendra M. Giza, Webster, NY (US); Andronique Ioannidis, Webster, NY (US); Michael Zak, Canandaigua, NY (US); Sandra Gardner, Oakville (CA); Nan-Xing Hu, Oakville (CA); Timothy P. Bender, Toronto (CA); Ah-Mee Hor, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 501 days.

This patent is subject to a terminal disclaimer.

(21) Appl. No.: 11/240,446

(22) Filed: Oct. 3, 2005

(65) Prior Publication Data

US 2007/0077508 A1 Apr. 5, 2007

(51) Int. Cl.
*G03G 5/10* (2006.01)

(52) U.S. Cl. ..... 430/69; 430/127

(58) Field of Classification Search ..... 430/69, 430/127

See application file for complete search history.

(56) References Cited

U.S. PATENT DOCUMENTS

| | | | | |
|---|---|---|---|---|
| 4,780,385 | A | 10/1988 | Wieloch et al. | |
| 5,362,332 | A | 11/1994 | Shimizu et al. | |
| 5,576,130 | A | 11/1996 | Yu et al. | |
| 5,792,582 | A | 8/1998 | Yuh et al. | |
| 2004/0249023 | A1 * | 12/2004 | Stoffer et al. | 524/48 |
| 2004/0249043 | A1 * | 12/2004 | Stoffer et al. | 524/430 |
| 2007/0178396 | A1 * | 8/2007 | Wu et al. | 430/69 |

* cited by examiner

*Primary Examiner*—John L Goodrow
(74) *Attorney, Agent, or Firm*—Pillsbury Winthrop Shaw Pittman LLP

(57) ABSTRACT

This invention relates to a method for improving chemical stability in a metal or metallized substrate, such as an aluminum substrate, of an electrophotographic-imaging member by treating the substrate with a composition containing a rare-earth metal.

20 Claims, 5 Drawing Sheets

METHOD OF TREATING AN ELECTROPHOTOGRAPHIC-IMAGING MEMBER WITH A RARE EARTH MATERIAL

FIELD OF THE INVENTION

This invention relates to methods of treating the substrate of electrophotographic-imaging members, which may be used as photoreceptors in various devices, such as copy machines. The methods reduce corrosion, fatigue, and printable defects on the substrate.

BACKGROUND

In the art of electrophotography, an electrophotographic plate comprising a photoconductive insulating layer on a conductive layer is imaged by first uniformly electrostatically charging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

Electrophotographic imaging members are usually multilayered photoreceptors that comprise a substrate support, an electrically conductive layer, an optional hole blocking layer, an adhesive layer, a charge generating layer, and a charge transport layer in either a flexible belt form or a rigid drum configuration. Multilayered flexible photoreceptor belts may include an anti-curl layer on the back side of the substrate support, opposite to the side of the electrically active layers, to render the desired photoreceptor flatness. One type of multilayered photoreceptor comprises a layer of finely divided particles of a photoconductive inorganic compound dispersed in an electrically insulating organic resin binder. The charge generating layer is capable of photogenerating holes and injecting the photogenerated holes into the charge transport layer.

As more advanced, higher speed electrophotographic copiers, duplicators and printers were developed, the performance requirements for the xerographic components increased. Moreover, complex, highly sophisticated, duplicating and printing systems employed flexible photoreceptor belts, operating at very high speeds, have also placed stringent mechanical requirements and narrow operating limits as well on photoreceptors.

Ideally, a photoreceptor can be charged capacitively with no dark decay. However, typically during the charging step, charge depletion results in voltage potentials that are less than the ideal capacitive value. Charge depletion is the difference between the capacitive value and the actual potential on a photoreceptor.

The ground plane of many modern photoconductive imaging members must be highly flexible, adhere well to flexible supporting substrates, and exhibit predictable electrical characteristics within narrow operating limits to provide excellent toner images over many thousands of cycles.

One type of ground plane is aluminum. However, aluminum films are relatively soft and exhibit poor scratch resistance during photoreceptor fabrication processing. Oxidation of the aluminum ground plane occurs as electric current is passed across the junction between the metal and photoreceptor, leading to degradation of image quality.

The oxides of aluminum which naturally form on the aluminum metal employed as an electrical blocking layer prevent charge injection during charging of the photoconductive device. If the resistivity of this blocking layer becomes too great, a residual potential will build across the layer as the device is cycled. Since the thickness of the oxide layer on an aluminum ground plane is not stable, the electrical performance characteristics of a composite photoreceptor undergoes changes during electrophotographic cycling. The accelerated oxidation of the metal ground plane increases optical transmission, causes copy quality nonuniformity and can ultimately result in loss of electrical grounding capability.

After long-term use in an electrophotographic copying machine, multilayered photoreceptors utilizing the aluminum ground plane may be observed to exhibit a dramatic dark development potential change between cycles.

One type of printable defect is small unexposed areas on a photoreceptor that fail to retain an electrostatic charge. These defects become visible to the naked eye after development with toner material. On copies prepared by depositing black toner material on white paper, these defects may be white or black depending upon whether a positive or reversal image development process is employed. In positive image development, these defects appear as white spots in the solid image areas of the final xerographic print. In other words, the image areas on the photoreceptor corresponding to the white spot fails to attract toner particles in positive write-reading image development. In reversal image development, black spots appear in background areas of the final xerographic copy. The white spots and black spots always appear in the same location of the final electrophotographic copies during cycling of the photoreceptor. The white spots and black spots do not exhibit any single characteristic shape, are small in size, and are visible to the naked eye.

Corrosion limits photoreceptor electrical life and causes printable defects. Therefore, methods for reducing corrosion that do not negatively impact on retention of electrostatic charge or the mechanical integrity of the substrate are needed. This invention answers that need.

SUMMARY

This invention relates to a method for improving chemical stability in a metal or metallized substrate of an electrophotographic-imaging member, comprising (a) providing a metal or metallized substrate of an electrophotographic-imaging member, and (b) treating the metal or metallized substrate with a composition comprising a rare-earth metal.

This invention also relates to an electrophotographic-imaging member, comprising (a) a metal substrate having a rare-earth metal disposed on at least one of the surfaces of the metal substrate; and (b) one or more additional layers disposed on the metal substrate, wherein the additional layer or layers contain a charge-generating component and a charge-transport component.

This invention also relates to a method of preparing an electrophotographic-imaging member having a treated metal substrate, comprising (a) providing a metal substrate having an oxide surface; (b) treating the surface of the metal substrate with a solution containing a rare-earth metal to produce a treated metal substrate; and (c) applying to the treated metal substrate one or more additional layers containing a charge-generating component and a charge-transport component, to produce an electrophotographic-imaging member having a treated metal substrate.

DETAILED DESCRIPTION

Figure 1:
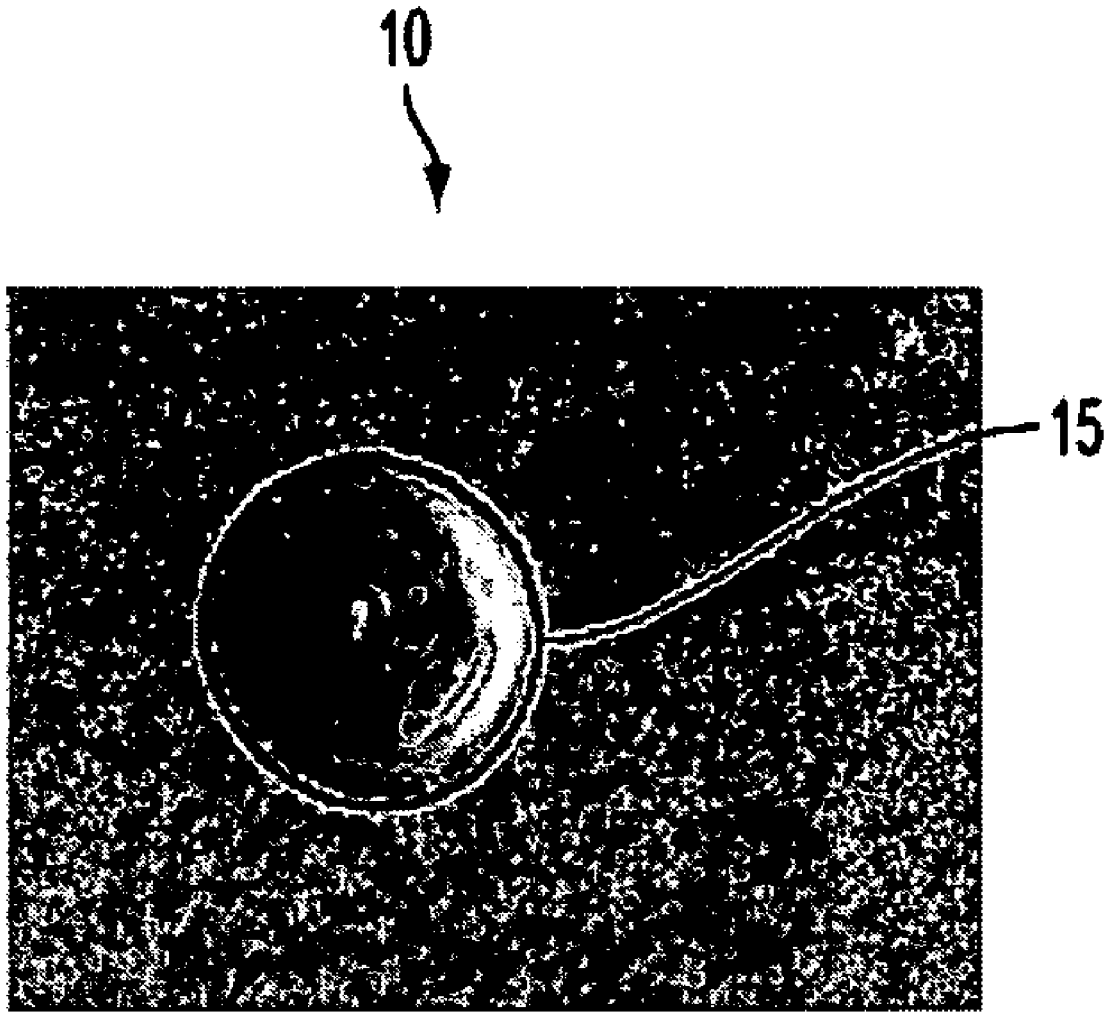
FIG. 1 shows a micrograph of an aluminum oxide pore filled by cerium.

This invention relates to a method for improving chemical stability in a metal or metallized substrate of an electrophotographic-imaging member, comprising (a) providing a metal or metallized substrate of an electrophotographic-imaging member, and (b) treating the metal or metallized substrate with a composition comprising a rare-earth metal. The method, which may be considered a passivation method, improves corrosion resistance on the substrate, inhibits the formation of printable defects, and extends photoreceptor life.

The substrate may be a metal substrate or a metallized substrate. While a metal substrate is substantially or completely metal, the substrate of a metallized substrate is made of a different material that has at least one layer of metal applied to at least one surface of the substrate. The material of the substrate of the metallized substrate can be any material for which a metal layer is capable of being applied. For instance, the substrate can be a synthetic material, such as a polymer.

Any metal or metal alloy can be used for the metal or metallized substrate. Typical metals employed for this purpose include aluminum, zirconium, niobium, tantalum, vanadium and hafnium, titanium, nickel, stainless steel, chromium, tungsten, molybdenum, and the like. Useful metal alloys may contain two or more metals such as zirconium, niobium, tantalum, vanadium and hafnium, titanium, nickel, stainless steel, chromium, tungsten, molybdenum, and the like. Aluminum, such as mirror-finish aluminum, is the preferred metal for both the metal substrate and the metal in the metallized substrate. All types of substrates may be used, including honed substrates, anodized substrates, bohmite-coated substrates and mirror substrates.

Many metal and metallized substrates will form an oxide layer on the surface upon exposure to oxygen. Generally, the more porous a metal is, the more capable the metal is of being oxidized. Some metals, for instance aluminum, will forms pores on the surface during the formation of the oxide layer. The pores on the aluminum oxide surface are particularly suitable for being treated with a solution containing a rare-earth metal. While not being bound by any theory, it is believed that the rare-earth metal in the solution is able to deposit in the pores of the oxide surface layer in a manner that facilitates the coating of the rare-earth metal on the oxide surface of the substrate.

If the metal or metallized substrate does not readily form an oxide layer on the surface, it may nonetheless be treated. Also, some metal and metallized substrates are more suitable for treatment without an oxide layer formed on the surface. In either of these cases, the metal or metallized substrate can nonetheless be treated.

In instances when it is preferable to treat a metal or metallized substrate that does not have an oxide layer on the surface, the oxide layer may be stripped or otherwise removed from metal or metallized substrate to expose the metal or metallized substrate prior to treatment. Treatment to the exposed metal or metallized substrate could thus be considered an in-situ treatment.

The substrate may be treated with the composition containing a rare-earth metal by methods known in the art. The treatment should result in the formation of a layer of rare-earth metal on the surface of the substrate being treated. For example, the substrate may be treated by immersing the substrate in a solution containing one or more ions from the rare-earth metal. The immersion period should last for a time sufficient to allow the ions to react or otherwise adhere to the surface of the substrate. Immersions periods may be as short an hour or less, or as long as 10 or more days, depending on the temperature, the substrate used, the concentration of the solution, the rare-earth metal used, the desired thickness or completeness of the coating layer on the substrate, and other factors familiar to those in the art.

All known rare-earth metals may be used to treat the metal or metallized substrate. Of the rare-earth metals, yttrium, lanthanum, neodymium, praseodymium, and cerium are preferred, with cerium being the most preferred.

The composition containing the rare-earth metal may include other components provided those additional components do not interfere with the function of the rare-earth metal. Preferably, the composition containing the rare-earth metal is a solution containing the rare-earth metal. While water is the preferred solvent in the solution, any solvent that ionizes the rare-earth metal or otherwise allows the rare-earth metal to dissociate is acceptable. The amount of rare-earth metal in solution can vary depending on the type of rare-earth metal used, the type of solution used, whether and the amount of heat used during the substrate treatment process, how long the substrate is exposed to the solution, and other factors known by those of skill in the art. Generally, a solution containing 100 ppm to 100,000 ppm is sufficient to treat the substrate.

This invention also relates to an electrophotographic-imaging member, comprising (a) a metal substrate having a rare-earth metal disposed on at least one of the surfaces of the metal substrate; and (b) one or more additional layers disposed on the metal substrate, wherein the additional layers comprise a charge-generating component and a charge-transport component.

The additional layers containing the charge-transport component and the charge-generating component may be applied as a single layer or may be applied separately as two distinct layers. The decision of whether to apply the components as a single layer or separate layers lies within the preference of the skilled artisan. Traditionally, the components are applied as separate layers; however, applying the components as a single layer may prove more convenient, cheaper, and may result in an electrophotographic-imaging member that is thinner or contains other desirable properties. The additional layers, whether as a single layer or separate layers, may be applied by techniques known to those in the art, such as chemical vaporization, sputtering, spraying, dipping, and spin-and-roller coating.

The thickness of the device typically ranges from about 2 μm to about 100 μm; preferably from about 5 μm to about 50 μm, and most preferably from about 10 μm to about 30 μm. The thickness of each layer will depend on how many components are contained in that layer, how much of each component is desired in the layer, and other factors familiar to those in the art. If the charge-generating component and charge-transport component are applied in separate layers, the ratio of the thickness of the layer containing the charge-transport component to the layer containing the charge-generating component typically ranges from about 2:1 to 400:1, preferably from about 2:1 to about 200:1.

The charge-transport component transports charge from the charge-generating layer to the surface of the photoreceptor. Often, the charge-transport component is made up of several materials, including electrically active organic-resin materials such as polymeric arylamine compounds, polysilylenes (such as poly(methylphenyl silylene), poly(methylphenyl silylene-co-dimethyl silylene), poly(cyclohexylmethyl silylene), and poly(cyanoethylmethyl silylene)), and polyvinyl pyrenes. The charge-transport component preferably contains at least one compound having an arylamine, enamine, or hydrazone group. The arylamine group may be represented in a compound having the formula:

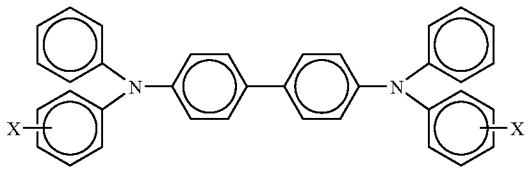

where X is an alkyl or a halogen. The compound containing the arylamine may be dispersed in a resinous binder, such as a polycarbonate or a polystyrene. A preferred compound having an arylamine group is N,N'-diphenyl-N,N-bis(3-methyl phenyl)-1,1'-biphenyl-4,4'-diamine.

The charge-generating component converts light input into electron whole pairs. Examples of compounds suitable for use as the charge-generating component include vanadyl phthalocyanine, metal phthalocyanines (such as titanyl phthalocyanine, chlorogallium phthalocyanine, hydroxygallium phthalocyanine, and alkoxygallium phthalocyanine), metal-free phthalocyanines, benzimidazole perylene, amorphous selenium, trigonal selenium, selenium alloys (such as selenium-tellurium, selenium-telluriumarsenic, selenium arsenide), chlorogallium phthalocyanin, and mixtures thereof.

The additional layer or layers containing the charge-transport and charge-generating components can include various other materials, such as binder polymeric resin materials, film-including particles, or resin layers having a photoconductive material. If the charge-transport component and charge-generating component are applied in separate layers, the layer containing the charge-generating component will preferably contain the resinous binder composition. Suitable polymeric film-forming binder materials include, but are not limited to, thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, amino resins phenylene oxide resins, terephthalic acid resins, phenoxy resins, epoxy resins, phenolic resins, polystyrene and acrylonitrile copolymers, polyvinyl chloride, vinylchloride and vinyl acetate copolymers, acrylate copolymers, alkyd resins, cellulosic film formers, poly(amideimide), styrene-butadiene copolymers, vinylidinechloride-vinylchloride copolymers, vinylacetate-vinylidenechloride copolymers, vinylacetate-vinylidenechloride copolymers, styrene-alkyd resins, polyvinylcarbazole, and mixtures thereof.

The charge-generating component may also contain a photogenerating composition or pigment. The photogenerating composition or pigment may be present in the resinous binder composition in various amounts, ranging from about 5% by volume to about 90% by volume (the photogenerating pigment is dispersed in about 10% by volume to about 95% by volume of the resinous binder); preferably from about 20% by volume to about 30% by volume (the photogenerating pigment is dispersed in about 70% by volume to about 80% by volume of the resinous binder composition). In one embodiment, about 8 percent by volume of the photogenerating pigment is dispersed in about 92 percent by volume of the resinous binder composition. When the photogenerating component contains photoconductive compositions and/or pigments in the resinous binder material, the thickness of the layer typically ranges from about 0.1 μm to about 5.0 μm, preferably from about 0.3 μm to about 3 μm. The photogenerating layer thickness is often related to binder content, for example, higher binder content compositions typically require thicker layers for photogeneration. Thicknesses outside these ranges may also be selected.

The electrophotographic-imaging member may further contain an undercoat layer between the metal or metallized substrate and the additional layers, and/or an overcoat layer on top of the additional layers. Thus the undercoat and overcoat layers are applied below and on top of the additional layers.

The overcoat layer may be applied on top of the additional layers to protect the charge-transport component and increase resistance to abrasion. Suitable overcoat layers include silicon-containing resins and cross-linked material having a skeleton having organic groups having charge-transporting properties. In such a composition, the silicon atom may be bound to the same or different carbon atom in the organic group, and the oxygen atom may be bonded to the silicon atom. The thickness of the overcoat layer typically ranges from about 2 μm to about 10 μm, preferably from about 3 μm to about 7 μm.

The undercoat layer, if introduced, is applied below the additional layers and above the substrate. The undercoat is typically responsible for blocking holes or charge from injecting into the device from the substrate. The undercoat layer may contain an electron-blocking component and/or electron-transporting substance. Examples of the material that may be used for the undercoating layer include an organic zirconium compound (such as a zirconium chelate compound, a zirconium alkoxide compound, or a zirconium coupling agent), an organic titanium compound (such as a titanium chelate compound, a titanium alkoxide compound, or a titanate coupling agent), an organic aluminum compound (such as an aluminum chelate compound or an aluminum coupling agent), and an organic metallic compound (such as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound or an aluminum zirconium alkoxide compound). A silane coupling agent may also be contained in the undercoating layer, examples of which include vinyltrichlorosilane, vinyltrimethoxysilane, vinyltriethoxysilane, vinyl-tris-2-methoxy ethoxysilane, vinyltriacetoxysilane, γ-glycidoxypropyltrimethoxysilane, γ-methacryloxypropyl trimethoxysilane, γ-aminopropyltrimethoxysilane, γchloropropyltrimethoxysilane, γ-2-amino ethylpropyltrimethoxysilane, γ-mercaptopropyltrimethoxysilane, γ-ureidopropyltriethoxysilane and β-3,4-epoxycyclohexyltrimethoxysilane. Furthermore, a binder resin may also be used in the undercoating layer, examples of which include polyvinyl alcohol, polyvinyl methyl ether, poly-N-vinylimidazole, polyethylene oxide, ethylcellulose, methylcellulose, an ethylene-acrylic acid copolymer, polyamide, polyimide, casein, gelatin, polyethylene, polyester, a phenol resin, a vinyl chloride-vinyl acetate copolymer, an epoxy resin, polyvinylpyrrolidone, polyvinylpyridine, polyurethane, polyglutamic acid, and polyacrylic acid.

As known by those of skill in the art, if positive charging is used, an electron-blocking layer is typically also used; if negative charging is used, a hole-blocking layer is typically also used. Charge blocking refers to both electron blocking and hole blocking. Some of the materials that form the undercoat layer can function as both an adhesive layer and a charge-blocking layer. Typical charge-blocking layers include crosslinked polymer resin containing a dispersion of $TiO_2$ (titania) and $SiO_2$ (silica), polyvinylbutyral, organosilanes, epoxy resins, polyesters, polyamides, polyurethanes, silicones and the like. The polyvinylbutyral, epoxy resins, polyesters, polyamides, and polyurethanes can also serve as an adhesive layer. Adhesive and charge-blocking layers preferably have a dry thickness between about 0.002 μm (20 Angstroms) and about 20 μm. Silanes and silane reaction products such as those described in U.S. Pat. No. 4,464,450, the disclosure of which is totally incorporated herein by reference, can be used as effective hole blocking layer material because its cyclic stability is extended. Silanes that can be used for making the hole-blocking layer of the photoreceptor include hydrolyzable silanes, such as 3-aminopropyltriethoxysilane, N-amino ethyl-3-aminopropyltrimethoxy-silane, N-2-aminoethyl-3-aminopropyltrimethoxy silane, N-2-aminoethyl-3-aminopropyltris(ethylethoxy) silane, p-aminophenyl trimethoxysilane, 3-amino propyldiethylmethylsilane, (N,N'-dimethyl 3-amino)-propyltriethoxy-silane, 3-aminopropyl methyldiethoxysilane, 3-aminopropyl trimethoxy-silane, N-methylaminopropyltriethoxysilane, methyl[2-(3-trimethoxysilylpropylamino)-ethylamino]-3-proprionate, (N,N'-dimethyl 3-amino) propyl triethoxysilane, N,N-dimethylaminophenyltriethoxysilane, trimethoxysilylpropyl diethylenetriamine and mixtures thereof. Good hole-blocking properties may be achieved when the reaction product of a hydrolyzed silane and metal oxide layer forms a blocking layer having a thickness of from about 0.002 μm to about 20 μm.

This invention also relates to a method of preparing an electrophotographic-imaging member having a treated metal substrate, comprising (a) providing a metal substrate having an oxide surface; (b) treating the surface of the metal substrate with a solution containing a rare-earth metal to produce a treated metal substrate; and (c) applying to the treated metal substrate one or more additional layers containing a charge-generating component and a charge-transport component, to produce an electrophotographic-imaging member having a treated metal substrate.

EXAMPLE 1

A bare clean mirror finish aluminum substrate was immersed in a 1000 ppm $CeCl_3$ aqueous solution for 10 days. The substrate was then thoroughly rinsed with distilled water. After treatment in the cerium solution, the drum possesses a dull yellow/gold appearance. A SEM micrograph of a pore in the aluminum oxide which has been filled by cerium is shown in FIG. 1.

EXAMPLE 1a

An untreated substrate consisting of a bare clean mirror finish aluminum substrate was used for comparison purposes with the treated substrate of Example 1.

EXAMPLE 2

Photoreceptor devices (P/R devices) or imaging members were fabricated with the following architectures in the sequence from bottom to top: an undercoat layer, a photogenerating layer, and a charge transport layer with a dielectric constant of about 3.

The undercoat layer was prepared as follows. A titanium oxide/phenolic resin dispersion was prepared by ball milling 15 grams of titanium dioxide (STR60N™, Sakai Company), 20 grams of the phenolic resin (VARCUM™ 29159, OxyChem Company, Mw of about 3,600, viscosity of about 200 cps) in 7.5 grams of 1-butanol, and 7.5 grams of xylene with 120 grams of 1-millimeter diameter sized $ZrO_2$ beads for 5 days. Separately, a slurry of $SiO_2$ and a phenolic resin was prepared by adding 10 grams of $SiO_2$ (P100, Esprit) and 3 grams of the above phenolic resin into 19.5 grams of 1-butanol and 19.5 grams of xylene. The resulting titanium dioxide dispersion was filtered with a 20 micrometer pore size nylon cloth to obtain a median $TiO_2$ particle size of 50 nanometers in diameter and a $TiO_2$ particle surface area of 30 $m^2$/gram with reference to the above $TiO_2$/VARCUM™ dispersion, as measured by a Horiba Capa 700 Particle Size Analyzer. Additional solvents of 5 grams of 1-butanol, 5 grams of xylene, 2.6 grams of bisphenol S (4,4'-sulfonyidiphenol), and 5.4 grams of the above prepared $SiO_2$/VARCUM™ slurry were added to 50 grams of the above resulting titanium dioxide/VARCUM™ dispersion, referred to as the coating dispersion.

An aluminum pipe of 30 millimeter in diameter and 340 millimeters in length as described in Example 1 is cleaned with detergent and rinsed with deionized water and dip coated in the coating dispersion at a pull rate of 160 millimeters/minute, and subsequently, dried at 160° C. for 15 minutes, which resulted in an undercoat layer (UCL) comprised of $TiO_2$/$SiO_2$/VARCUM™/bisphenol S with a weight ratio of about 52.7/3.6/34.5/9.2 and a thickness of 3.5 microns.

A 0.5 micron thick photogenerating layer was subsequently coated on top of the above generated undercoat layer from a dispersion of chlorogallium phthalocyanine Type B (3 parts), and a vinyl chloride/vinyl acetate copolymer, VMCH (Mn equal to 27,000, about 86 weight percent of vinyl chloride, about 13 weight percent of vinyl acetate and about 1 weight percent of maleic acid) available from Dow Chemical (2 parts), in 95 grams of toluene/n-butylacetate with a weight ratio of 2 to 1.

Subsequently, a 24 μm thick charge transport layer was coated on top of the photogenerating layer from a solution of N,N'-diphenyl-N,N-bis(3-methyl phenyl)-1,1'-biphenyl-4,4'-diamine (8.8 parts) and a polycarbonate, PCZ-400 [poly(4,4'-dihydroxy-diphenyl-1-1-cyclohexane, Mw equal to 40,000)] available from Mitsubishi Gas Chemical Company, Ltd. (13.2 parts) in a mixture of 55 grams of tetrahydrofuran (THF) and 23.5 grams of toluene. The charge-transport layer was dried at 120° C. for 45 minutes.

EXAMPLE 2a

An aluminum pipe of 30 millimeter in diameter and 340 millimeters in length as described in Example 1a is treated with the undercoat layer, photogenerating layer, and charge-generating layer as described in Example 2.

EXAMPLE 3

Cycling Stability

Figure 2:
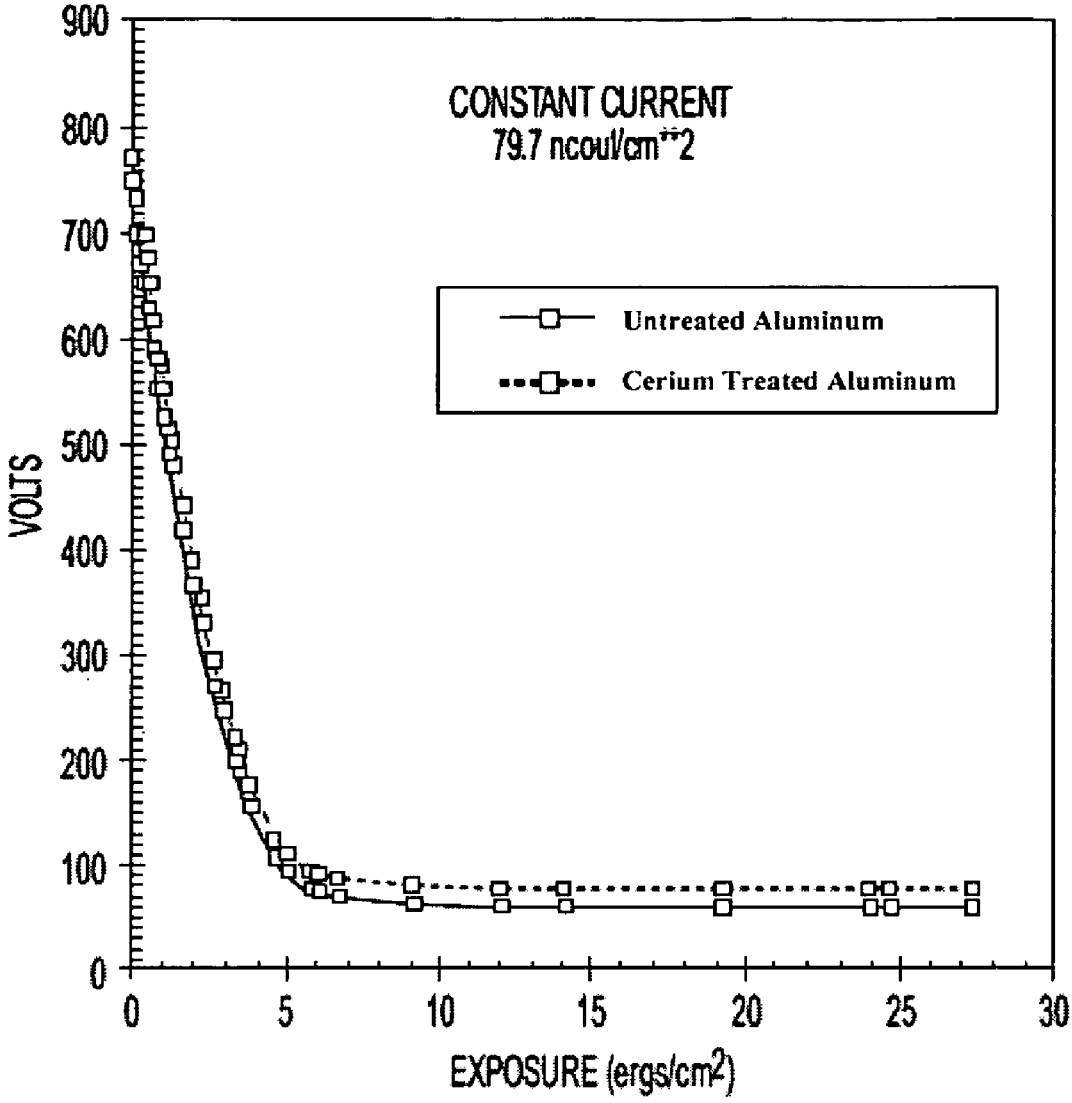
FIG. 2 is a graph comparing the surface potential on two substrates upon exposure to various light intensities: (a) a polycarbonate doped with arylamine compound (charge-transport layer)/chlorogallium(III)phthalocyanine (charge-generating layer)/crosslinked polymer resin containing a dispersion of $TiO_2$ and $SiO_2$ (undercoat layer)/Mirror aluminum substrate; and (b) a polycarbonate doped with arylamine compound (charge transport layer)/chlorogallium(III)phthalocyanine (charge-generating layer)/crosslinked polymer resin containing a dispersion of $TiO_2$ and $SiO_2$ (undercoat layer)/CeO-treated mirror aluminum substrate.

The drums of Example 2 were tested for cycling stability. As can be seen by the graph in FIG. 2, cerium was found to have a minimal effect on time zero properties with only a slightly elevated PIDC tail of approximately 10 to approximately 15 volts. This confirms that the cerium-treated oxide layer has not increased the resistivity to unacceptable levels.

EXAMPLE 4

Device Performance

The cerium-treated drum and control drum of Example 2 were then cycled out to 530 k on a hyper-mode test fixtures (a stress cycling test) at 170 k intervals in high-humidity (85%) and high-temperature (28° C.) conditions. As shown in the table below, cerium treatment had no significant effect on the amount of $V_{low}$ cycle up, but it did slightly reduce the amount of $V_{high}$ cycle down. This confirms that the cerium treatment did not cause a negative impact on the device performance.

| Example | Substrate | UCL | $V_{high}$ (0k) | $V_{low}$ (0k) | $V_{high}$ (530k) | $V_{low}$ (530k) |
|---|---|---|---|---|---|---|
| 2a | bare | titania/silica | 700 | 35 | 642 | 52 |
| 2 | cerium treated | titania/silica | 702 | 35 | 657 | 58 |

EXAMPLE 5

Corrosion Resistance

Figure 3:
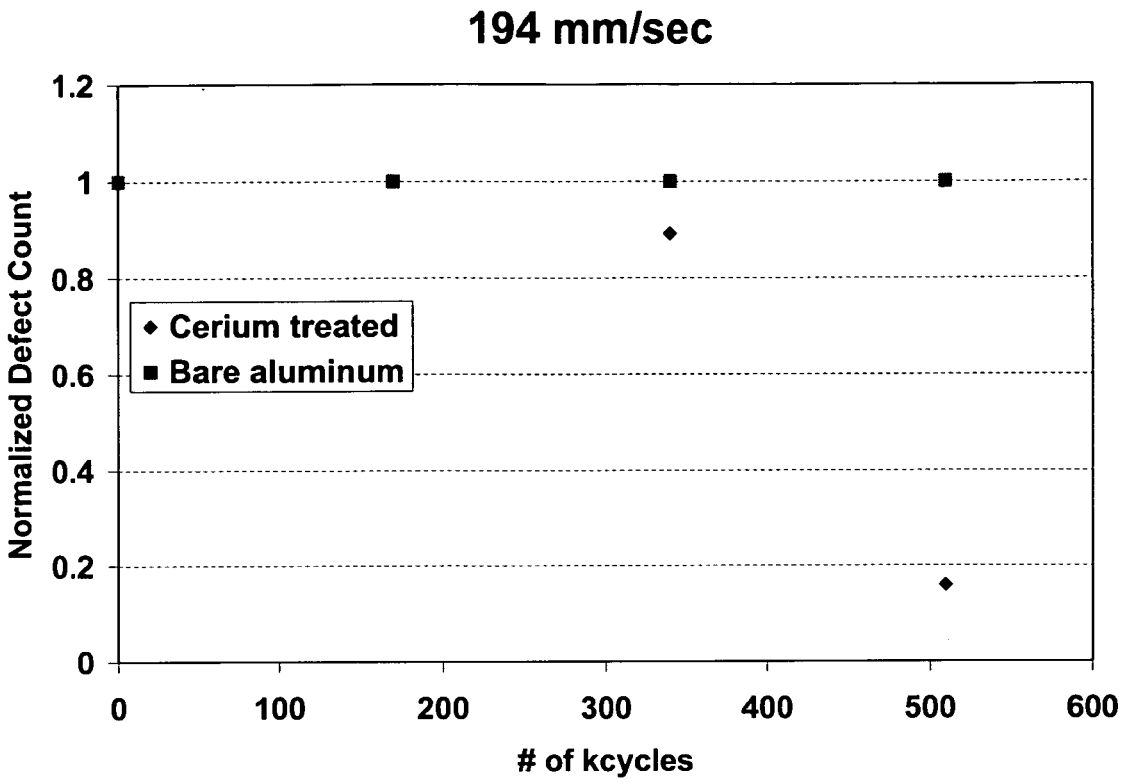
FIG. 3 is a scatter plot analyzing the defect count of two drum photoreceptors on a 10 cm×10 cm section of a piece of paper per number of kilocycles of turns where the drum is printed at 194 mm/sec: (a) a polycarbonate doped with arylamine compound (charge-transport layer)/chlorogallium (III)phthalocyanine (charge-generating layer)/crosslinked polymer resin containing a dispersion of $TiO_2$ and $SiO_2$ (undercoat layer)/Mirror aluminum substrate drum photoreceptor; and (b) a polycarbonate doped with arylamine compound (charge-transport layer)/chlorogallium(III)phthalocyanine (charge-generating layer)/crosslinked polymer resin containing a dispersion of $TiO_2$ and $SiO_2$ (undercoat layer)/CeO-treated mirror aluminum substrate drum photoreceptor. The results of FIG. 3 have been normalized so that the highest number of defects is treated as the value 1.00 at each printing interval (the drum is printed approximately every 170 kilocycles).
Figure 4:
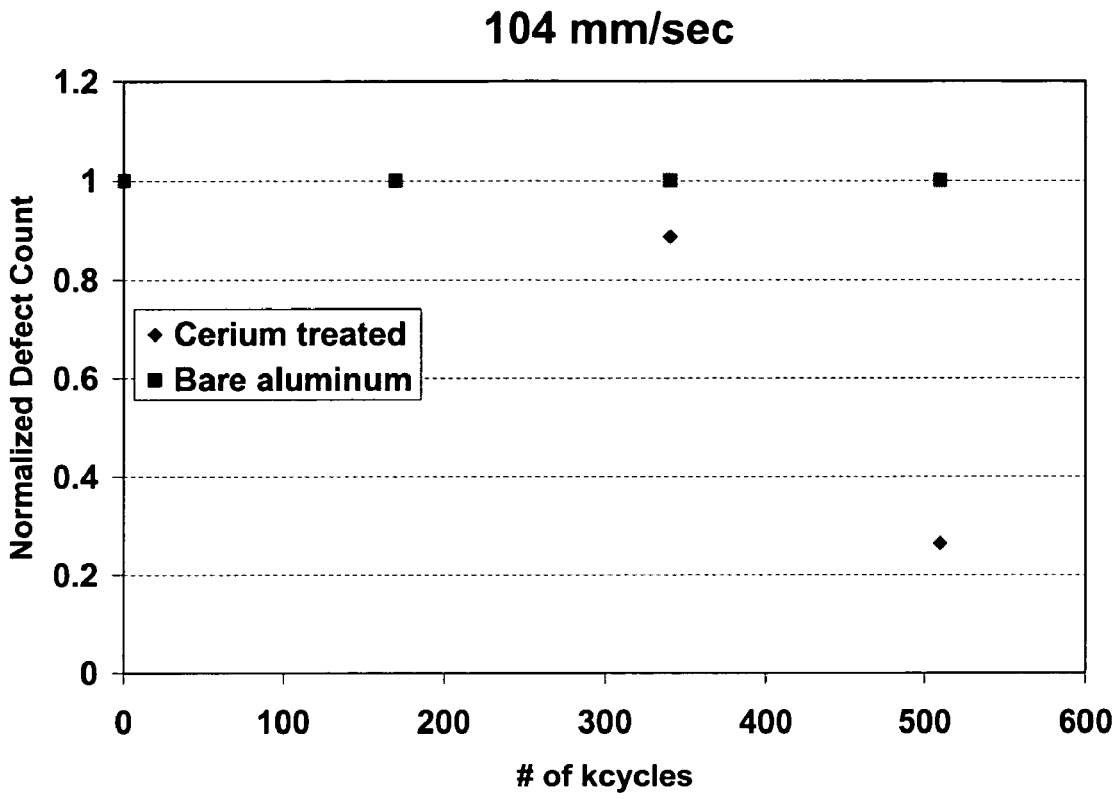
FIG. 4 is a scatter plot analyzing the defect count of two drum photoreceptors on a 10 cm×10 cm section of a piece of paper per number of kilocycles of turns where the drum is printed at 104 mm/sec.: (a) a polycarbonate doped with arylamine compound (charge-transport layer)/chlorogallium (III)phthalocyanine (charge-generating layer)/crosslinked polymer resin containing a dispersion of $TiO_2$ and $SiO_2$ (undercoat layer)/Mirror aluminum substrate drum photoreceptor; and (b) a polycarbonate doped with arylamine compound (charge-transport layer)/chlorogallium(III)phthalocyanine (charge-generating layer)/crosslinked polymer resin containing a dispersion of $TiO_2$ and $SiO_2$ (undercoat layer)/CeO-treated mirror aluminum substrate drum photoreceptor. The results of FIG. 4 have been normalized so that the highest number of defects is treated as the value 1.00 at each printing interval (the drum is printed approximately every 170 kilocycles).
Figure 5:
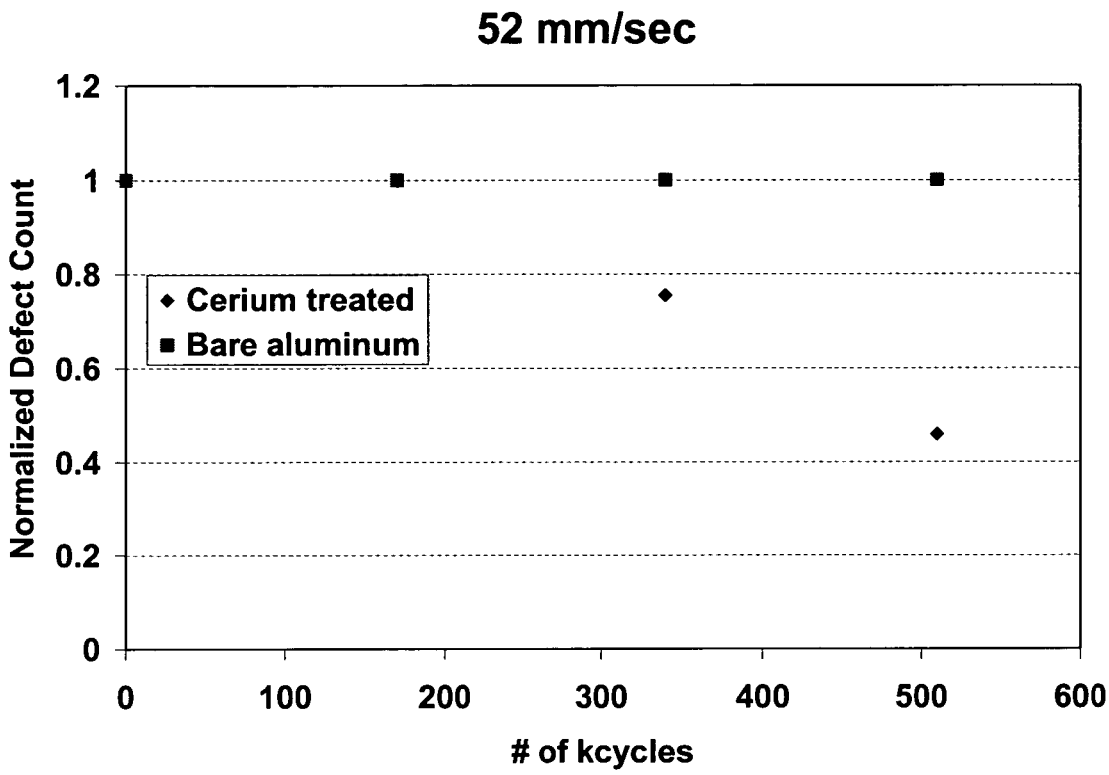
FIG. 5 is a scatter plot analyzing the defect count of two drum photoreceptors on a 10 cm×10 cm section of a piece of paper per number of kilocycles of turns where the drum is printed at 52 mm/sec. (nominal copy speed): (a) a polycarbonate doped with arylamine compound (charge-transport layer)/chlorogallium(III)phthalocyanine (charge-generating layer)/crosslinked polymer resin containing a dispersion of $TiO_2$ and $SiO_2$ (undercoat layer)/Mirror aluminum substrate drum photoreceptor; and (b) a polycarbonate doped with arylamine compound (charge-transport layer)/chlorogallium (III)phthalocyanine (charge-generating layer)/crosslinked polymer resin containing a dispersion of $TiO_2$ and $SiO_2$ (undercoat layer)/CeO-treated mirror aluminum substrate drum photoreceptor. The results of FIG. 5 have been normalized so that the highest number of defects is treated as the value 1.00 at each printing interval (the drum is printed approximately every 170 kilocycles).

The drums of Example 2 were tested at each 170 k interval of cycling on the hyper mode test fixtures, with test printing on a DC1632 printer. Three white blank pages were run at different processing speeds (194 mm/sec, 104 mm/sec and 52 mm/sec). The blank pages were then scanned and the number of printable defects were counted in a 10 cm×1 cm area. As seen in FIGS. 3-5, the graph shows the photoreceptors with the cerium-treated substrate possessed a lower print defect density after extended cycling, particularly at around 530 k and above. The difference between the two drums at 340 k was seen to be about 10% to about 20%. On the whole, the test confirms that the treatment of the aluminum substrate with cerium reduces the number of printable defects after continuous cycling, which is a measure of corrosion resistance.

All references cited in this specification, and their references, are totally incorporated herein by reference where appropriate for teachings of additional or alternative details, features, and/or technical background.

While the invention has been particularly shown and described with reference to particular embodiments, it will be appreciated that variations of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A method for improving chemical stability in a metal or metallized substrate of an electrophotographic-imaging member, comprising:

a. providing a metal or metallized substrate of an electrophotographic-imaging member;

b. treating the metal or metallized substrate with a composition comprising a rare-earth metal; and c. applying one or more additional layers disposed on the treated metal or metallized substrate, wherein the additional layer or layers comprise a charge-generating component and a charge-transport component.

2. The method of claim 1, wherein the rare-earth metal is selected from the group consisting of yttrium, lanthanum, neodymium, praseodymium, cerium, and combinations thereof.

3. The method of claim 2, wherein the rare-earth metal is cerium.

4. The method of claim 1, wherein the metal substrate is an aluminum substrate.

5. The method of claim 1, wherein the metallized substrate is a synthetic substrate having an aluminum surface.

6. The method of claim 1, wherein the metal or metallized substrate contains an oxide layer, and the oxide layer is treated with the composition comprising a rare-earth metal.

7. The method of claim 1, wherein treating the metal or metallized substrate comprises stripping away at least part of the oxide layer from the metal or metallized substrate and treating the exposed substrate.

8. An electrophotographic-imaging member, comprising:

a. a metal substrate having a rare-earth metal disposed on at least one of the Surfaces of the metal substrate; and b. one or more additional layers disposed on the metal substrate, wherein the additional layer or layers comprise a charge-generating component and a charge-transport component.

9. The electrophotographic-imaging member of claim 8, wherein the metal substrate is an aluminum substrate.

10. The electrophotographic-imaging member of claim 8, wherein the rare-earth metal is selected from the group consisting of yttrium, lanthanum, neodymium, praseodymium, cerium, and combinations thereof.

11. The electrophotographic-imaging member of claim 10, wherein the rare-earth metal is cerium.

12. The electrophotographic-imaging member of claim 8, further comprising an undercoat layer between the metal substrate and additional layers.

13. The electrophotographic-imaging member of claim 8, further comprising an overcoat layer on top of the additional layers.

14. The electrophotographic-imaging member of claim 8, wherein the charge-transport component comprises at least one compound having an arylamine group, an enamine group, a hydrazone group, or a combination thereof.

15. The electrophotographic-imaging member of claim 8, wherein the charge-generating component comprises a material selected from the group consisting of vanadyl phthalocyanine, metal phthalocyanines, metal-free phthalocyanine, hydroxygallium phthalocyanine, benzimidazole perylene, amorphous selenium, trigonal selenium, selenium alloys, chlorogallium phthalocyanin, and combinations thereof.

16. A method of preparing an electrophotographic-imaging member having a treated metal substrate, comprising:

a. providing a metal substrate having an oxide surface;

b. treating the surface of the metal substrate with a composition comprising a rare-earth metal to produce a treated metal substrate; and c. applying to the treated metal substrate one or more additional layers containing A charge-generating component and a charge-transport component to produce an electrophotographic-imaging member having a treated metal substrate.

17. The method of claim 16, wherein the rare-earth metal is selected from the group consisting of yttrium, lanthanum, neodymium, praseodymium, cerium, and combinations thereof.

18. The method of claim 17, wherein the rare-earth metal is cerium.

19. The method of claim 16, wherein the metal substrate is an aluminum substrate.

20. The method of claim 16, wherein the electrophotographic-imaging member further comprises an undercoat layer between the metal substrate and additional layers, and/or an overcoat layer on top of the additional layers.

* * * * *